United States Patent [19]

Abuyama

[11] Patent Number: 4,568,173

[45] Date of Patent: Feb. 4, 1986

[54] IMAGE FORMING APPARATUS

[75] Inventor: Yasuo Abuyama, Ebina, Japan

[73] Assignee: Kabushiki Kaisha Toshiba, Kawasaki, Japan

[21] Appl. No.: 681,574

[22] Filed: Dec. 13, 1984

[30] Foreign Application Priority Data

Dec. 22, 1983 [JP] Japan ..... 58-242607

[51] Int. Cl.[4] ..... G03G 15/00

[52] U.S. Cl. ..... 355/14 R; 355/56; 355/14 E; 355/8

[58] Field of Search ..... 355/14 R, 14 E, 8, 55, 355/56, 3 R

[56] References Cited

U.S. PATENT DOCUMENTS 3,945,023 3/1976 Stauffer ..... 358/56 X
4,277,163 7/1981 Ikesue et al. ..... 355/14 R
4,474,461 10/1984 Tokuhara ..... 355/56
4,475,805 10/1984 Omi ..... 355/56 X
4,498,759 2/1985 Ogawa et al. ..... 355/55 X

*Primary Examiner*—A. C. Prescott
*Attorney, Agent, or Firm*—Cushman, Darby & Cushman

[57] ABSTRACT

There is provided a copying machine in which a copying magnification and a copying density are variable. When the operation mode is set in the check mode and a copying start key is depressed, a document is copied once at a predetermined copying magnification or copying density. Thereafter, the copying magnification or the copying density is automatically changed, and the copying operation of the document is performed again. The above-mentioned operation is repeated until the copying operations at all the copying magnifications or the copying densities are completed.

4 Claims, 32 Drawing Figures

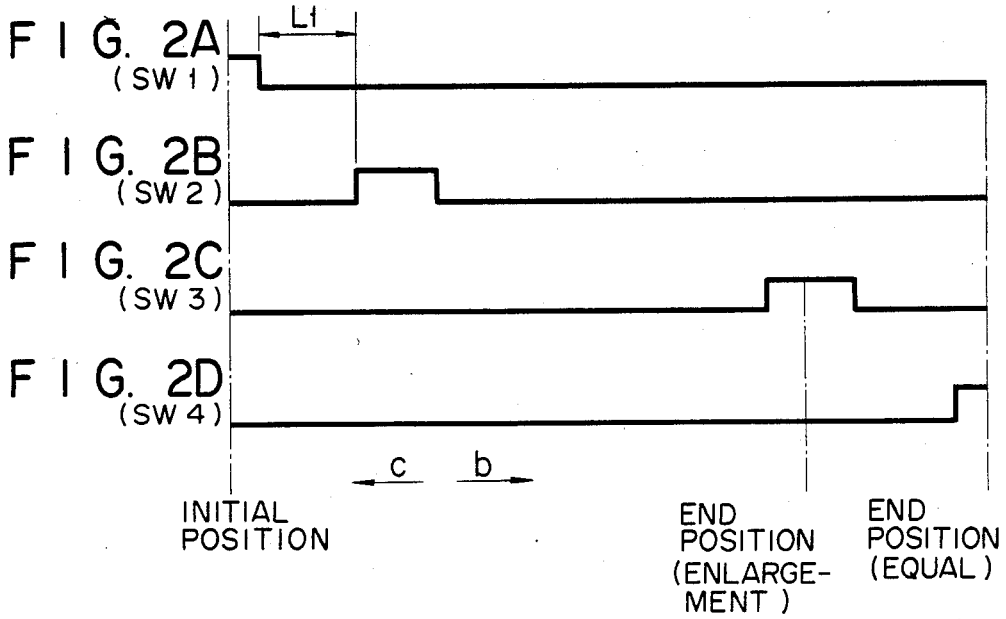
FIG. 3
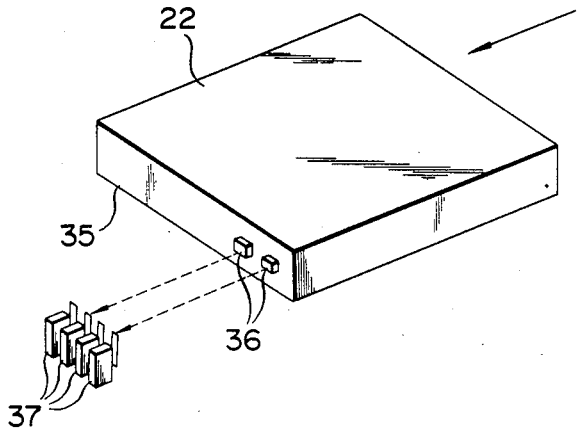

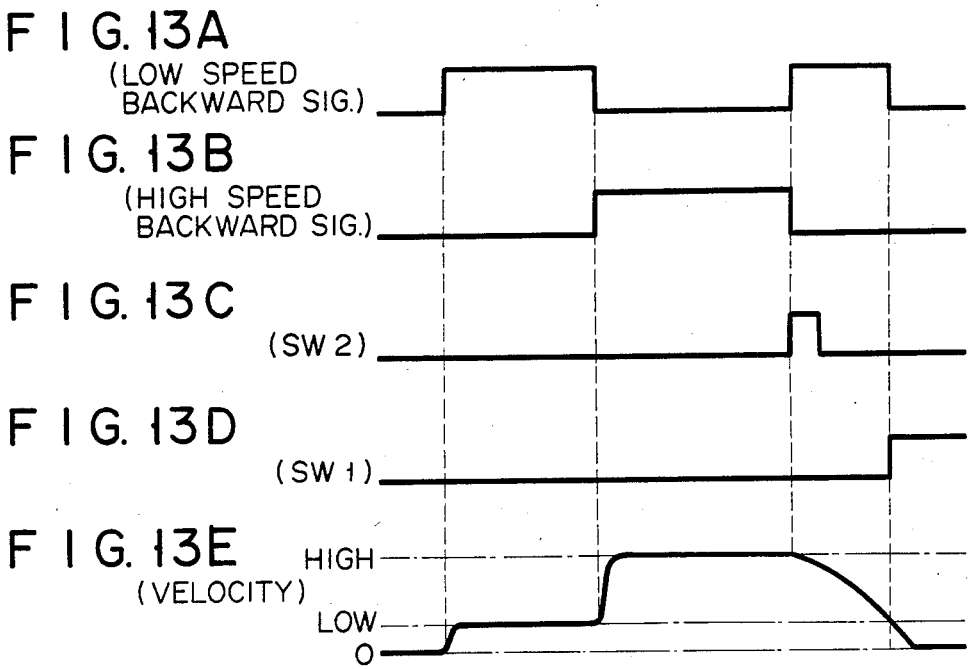
FIG. 13A
(LOW SPEED BACKWARD SIG.)
FIG. 13B
(HIGH SPEED BACKWARD SIG.)
FIG. 13C
(SW 2)
FIG. 13D
(SW 1)
FIG. 13E
(VELOCITY)
HIGH
LOW
0
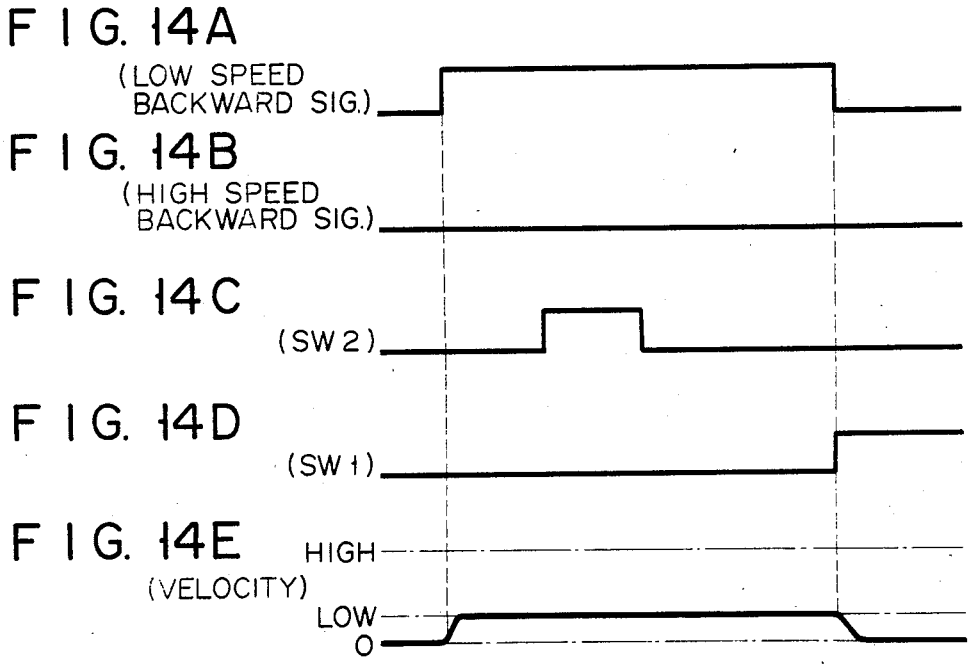
FIG. 14A
(LOW SPEED BACKWARD SIG.)
FIG. 14B
(HIGH SPEED BACKWARD SIG.)
FIG. 14C
(SW 2)
FIG. 14D
(SW 1)
FIG. 14E
(VELOCITY)
HIGH
LOW
0

IMAGE FORMING APPARATUS

BACKGROUND OF THE INVENTION

The present invention relates to an image forming apparatus such as a copying machine.

Recent image forming apparatuses such as copying machines have various functions. Parameters which represent such functions as the copying number, the copying paper size, the copying magnification, the copying density and the like will be referred to as image forming instructions hereafter. When such a copying machine is manufactured or is placed and used in an office, it may be necessary to check all the functions of the copying machine. A conventional checking operation is performed in such a manner that after all the functions of the copying machine are manually set at all possible values, a copying start instruction (depression of a start key) is provided. For this reason, the checking operation becomes complex and time-consuming according to the various functions of the copying machine.

SUMMARY OF THE INVENTION

It is an object of the present invention to provide an image forming apparatus in which image forming instructions can be variably set and a checking operation for copying operations under respective instructions can be easily performed.

In order to achieve the above object, there is provided an image forming apparatus comprising, image forming means responsive to an image signal and an instruction signal for forming an image on an image forming medium in accordance with an image forming instruction, designating means for generating a start signal which designates the start of a checking operation in accordance with an operation of an operating member and instruction changing means for supplying one instruction signal in accordance with the start signal from the designating means, and when the image is formed in accordance with the image forming instruction, for sequentially supplying other instruction signals to the image forming means until all the instruction signals have been supplied to the image forming means.

BRIEF DESCRIPTION OF THE DRAWINGS

FIGS. 2A to 2D are respectively timing charts showing the operation of switches for detecting movement of carriages of this embodiment;

FIG. 3 is a perspective view of a paper feed cassette of this embodiment;

FIGS. 13A to 13E and 14A to 14E are timing charts illustrating how the carriages return to the initial position.

DETAILED DESCRIPTION OF THE PREFERRED EMBODIMENT

An embodiment of the present invention will be hereinafter described with reference to the accompanying drawings.

Figure 1:
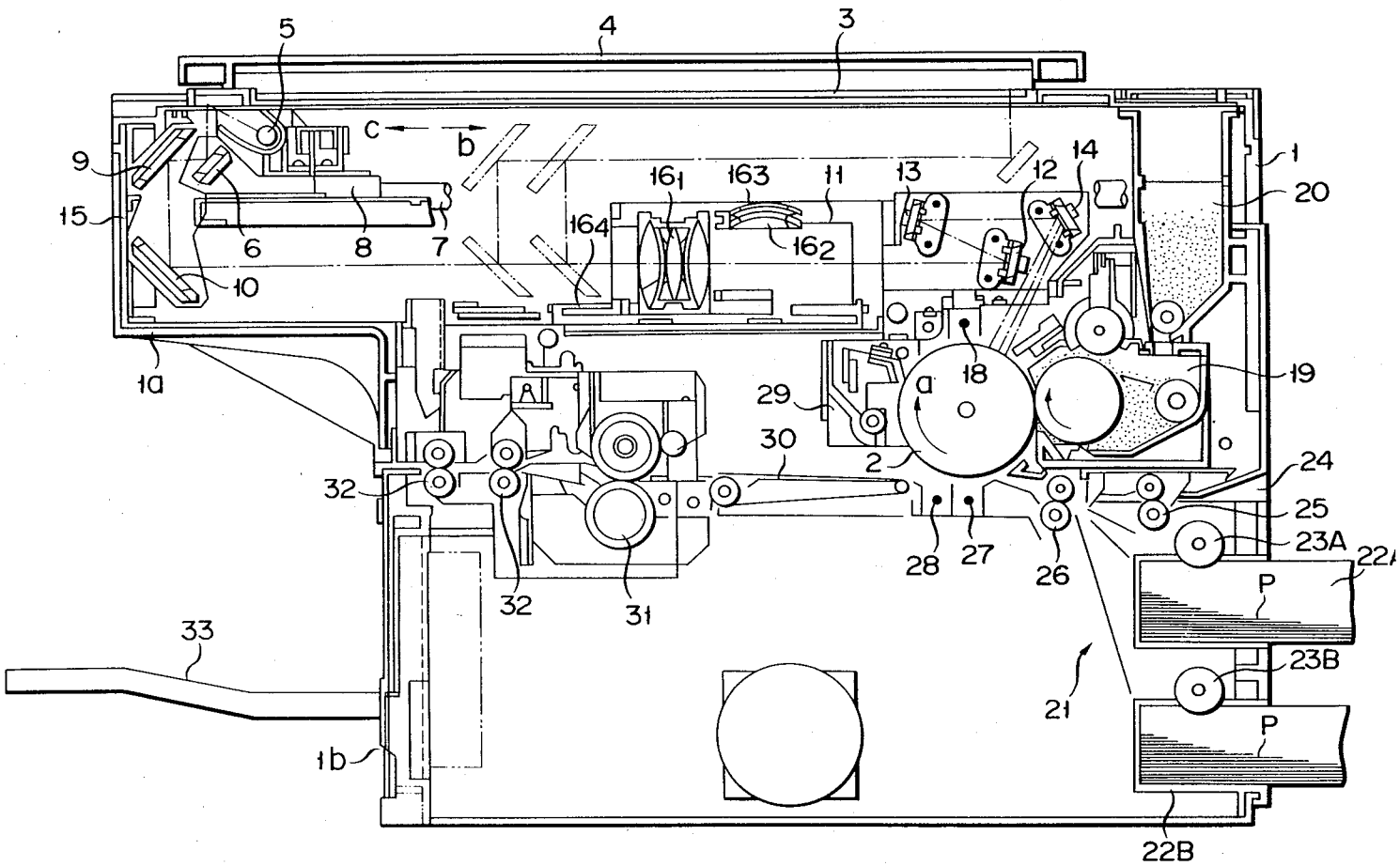
FIG. 1 is a sectional view showing a structure of a copying machine according to an embodiment of the present invention.

FIG. 1 shows a copying machine of document table fixed type as an embodiment of a copying machine according to the present invention. A photosensitive drum 2 which is rotated along a direction indicated by an arrow a in FIG. 1 is arranged at a substantially central portion of a housing 1 of the copying machine. A document table (transparent glass plate) 3 for placing a document thereon is fixed on an upper portion of the housing 1. A document cover 4 is provided on the document table 3 so as to be freely opened and closed. An exposure lamp 5 and a mirror 6 as an exposure means are provided under the document table 3. The exposure lamp 5 and the mirror 6 are mounted on a first carriage 8 which moves reciprocally along a guide shaft 7 in directions indicated by arrows b and c in FIG. 1. Upon movement of the first carriage 8, the exposure lamp 5 and the mirror 6 can optically scan from one end to the other or one side to the other of the document. Then, light emitted from the exposure lamp 5 and reflected by the document is supplied to a surface of the photosensitive drum 2 through the mirror 6, mirrors 9 and 10, a lens unit 11, and stationary mirrors 12, 13 and 14, thereby slit-exposing an image on the document. The mirrors 9 and 10 are mounted on a second carriage 15. The second carriage 15 moves with the first carriage 8 at a speed half that of the first carriage 8. The lens unit 11 consists of a main lens $\mathbf{16}_1$ which is movable along directions indicated by the arrows b and c, and magnification auxiliary lenses $\mathbf{16}_2$, $\mathbf{16}_3$ and $\mathbf{16}_4$ which are selectively arranged before and after the main lens $\mathbf{16}_1$ and which change the synthetic focal length of the overall lens system. Furthermore, the first and second carriages 8 and 15 are driven by single wires (not shown) which are looped around corresponding pulleys. The exposure lamp 5, the mirrors 6, 9 and 10, the lens unit 11 and the mirrors 12 to 14 constitute an optical system.

A discharger lamp 17 for discharging a residual charge on the surface of the photosensitive drum 2 and a charger 18 for charging the surface thereof are arranged around the photosensitive drum 2 along a rotating direction thereof. The surface of the photosensitive drum 2 which is alternately discharged and charged is exposed by the above-mentioned optical system so as to form an electrostatic latent image thereon. A developing unit 19 for visualizing the latent image on the photosensitive drum 2 with toner is provided adjacent to the charger 18. A toner hopper 20 for supplying toner to the developing unit 19 is provided above an upper portion thereof. A paper feed unit 21 for feeding paper sheets below the photosensitive drum 2 is arranged adjacent to the developing unit 19. The paper feed unit 21 comprises a manual feed port 24, an upper paper feed cassette 22A and a lower paper feed cassette 22B. The upper and lower sheet cassettes 22A and 22B are detachably loaded in the housing 1. The paper feed cassettes are made so as to correspond to sizes of copying paper sheets, and store paper sheets P. The two cassettes which are used more frequently than others are mounted on the housing 1. Paper feed rollers 23A and 23B for picking up the paper sheets P one by one are respectively provided above the paper feed cassettes 22A and 22B. One of the paper feed rollers 23A and 23B is selectively driven in response to a selection signal supplied from an operation panel (to be described later) so as to feed the paper sheet P to aligning rollers 26. A manual paper feed unit (not shown) is mounted on the manual paper feed port 24. The paper sheet P fed from the manual paper feed unit is fed to the aligning rollers 26 through paper feed rollers 25. The aligning rollers 26 align a leading end of the paper sheet P and feed the sheet P to an image transfer unit in synchronism with other units of the copying machine.

A transfer charger 27 for transferring a toner image formed on the surface of the photosensitive drum 2 onto the paper sheet P fed by the aligning rollers 26, and a peeling charger 28 for peeling the paper sheet P having the toner image thereon from the surface of the photosensitive drum 2 are provided in the image transfer unit arranged adjacent to the paper feed unit 21. A cleaning unit 29 for recovering residual toner particles remaining on the surface of the photosensitive drum 2 is arranged adjacent to the peeling charger 28.

A convey unit 30 for conveying the paper sheet separated from the photosensitive drum 2 is provided adjacent to the separation charger 28. Heat rollers 31 as a fixing unit for fixing the transferred image on the paper sheet is provided at a terminal end of the convey unit 30. The paper sheet on which the image is fixed thereon is exhausted by exhaust rollers 32 onto an exhaust tray 33 provided outside the housing 1.

The housing 1 is divided into upper and lower casings 1*a* and 1*b* having a convey path 30 at a boundary. Both the casings 1*a* and 1*b* are pivotally supported by a pivot shaft (not shown) at one end thereof such that the casing 1*a* can be opened at a predetermined angle. In the upper casing 1*a*, the photosensitive drum 2, the document table 3, the optical system, the charger 18, the developing unit 19, the paper feed rollers 25, the upper aligning roller 26, the cleaning unit 29, the heat roller 31, the upper exhaust rollers 32 and the like are arranged. In the lower casing 1*b*, the paper feed cassettes 22A and 22B, the paper feed rollers 23 and 25, the lower aligning roller 26, the chargers 27 and 28, the convey unit 30, the lower heat roller 31, the lower exhaust roller 32, the exhaust tray 33 and the like are arranged.

Although not shown in FIG. 1, position detection switches SW1 to SW4 which are turned on and off in accordance with the position of the second carriage 15 are provided in the path of the second carriage 15. The operation timing of these switches SW1 to SW4 is shown in FIGS. 2A to 2D. The switch SW1 is a detector for detecting an initial scanning position of the carriage 15 (indicated by a solid line in FIG. 1) as shown in FIG. 2A. The switch SW2 is a detector for detecting that the carriage 15 has reached a position at a predetermined distance from the switch SW1, as shown in FIG. 2B. The switch SW3 is a detector for detecting that the carriage 15 has reached the limit position in the enlargement copying mode, as shown in FIG. 2C. The switch SW4 is a detector for detecting that the carriage 15 has reached the limit position in the equal copying mode, as shown in FIG. 2D.

FIG. 3 is a perspective view showing a paper size detecting mechanism. A plurality of projections 36 are provided on one side surface of the paper feed cassette 22A or 22B, that is, the side surface opposing the direction of cassette insertion (front end face). A size of the paper sheet P stored in the paper feed cassette 22A or 22B can be expressed by a combination of the position and number of the projections 36. When the paper feed cassette 22A or 22B is mounted on the housing 1, those of a plurality of microswitches 37 provided in the housing 1 which correspond to the above projections 36 are thereby turned on. Thus, the paper size can be determined by combinations of ON and OFF of the switches 37.

Figure 4:
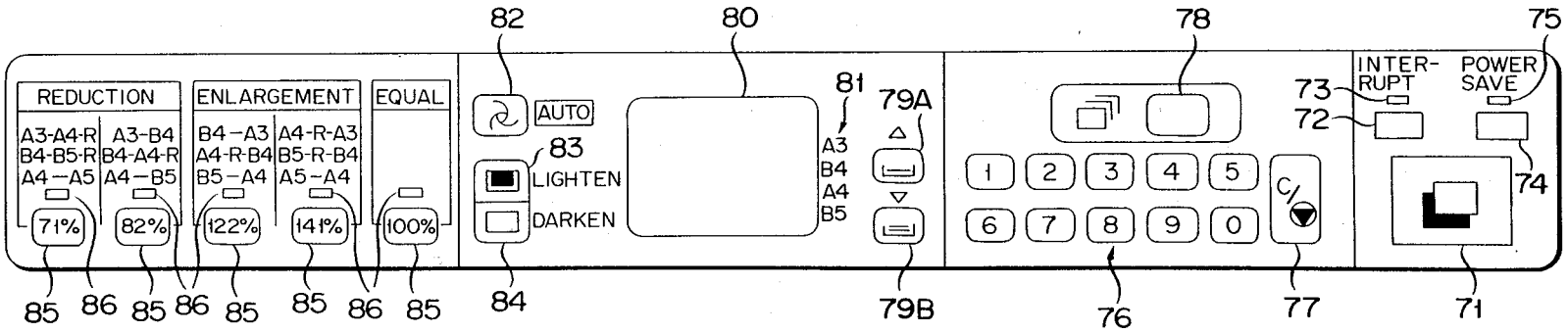
FIG. 4 is a plan view of an operation panel of this embodiment.

FIG. 4 shows an operation panel arranged at the upper surface of the housing 1. The operation panel comprises a copying key 71 for starting the copying operation, an interrupt key 72 for designating the interrupt mode to perform the interrupt operation, an indicator 73 which is illuminated when the interrupt key 72 is depressed, a power save key 74 for designating the power save mode, a power save indicator 75 which is illuminated when the power save key 74 is depressed, ten keys 76 for setting the copying number, a clear/stop key 77 for clearing the preset copying number or stopping the copying operation, a copying number display 78 for displaying the copying number, paper size (cassette) selection keys 79A and 79B for selecting the size of the copying paper by selecting one of the paper feed cassettes 22A and 22B, a liquid crystal display unit 80 for displaying various states of the copying machine such as the selected copying density, the selected paper size and the like, a paper size display 81 on which respective paper sizes (e.g., A3, B4, A4 and B5) are displayed, an automatic exposure key 82 selecting the automatic exposure mode by which the optimum copying density can be obtained in accordance with the density of the document, a lighten key 83 (for lightening the copying density) and a darken key 84 (for darkening the copying density) which select the desired copying density in the manual exposure mode, magnification set keys 85 for setting the desired copying magnification (e.g., 71%, 82%, 122%, 141% and 100%), and magnification indicators 86 which are illuminated when corresponding magnification set keys 86 are depressed.

Figure 5:
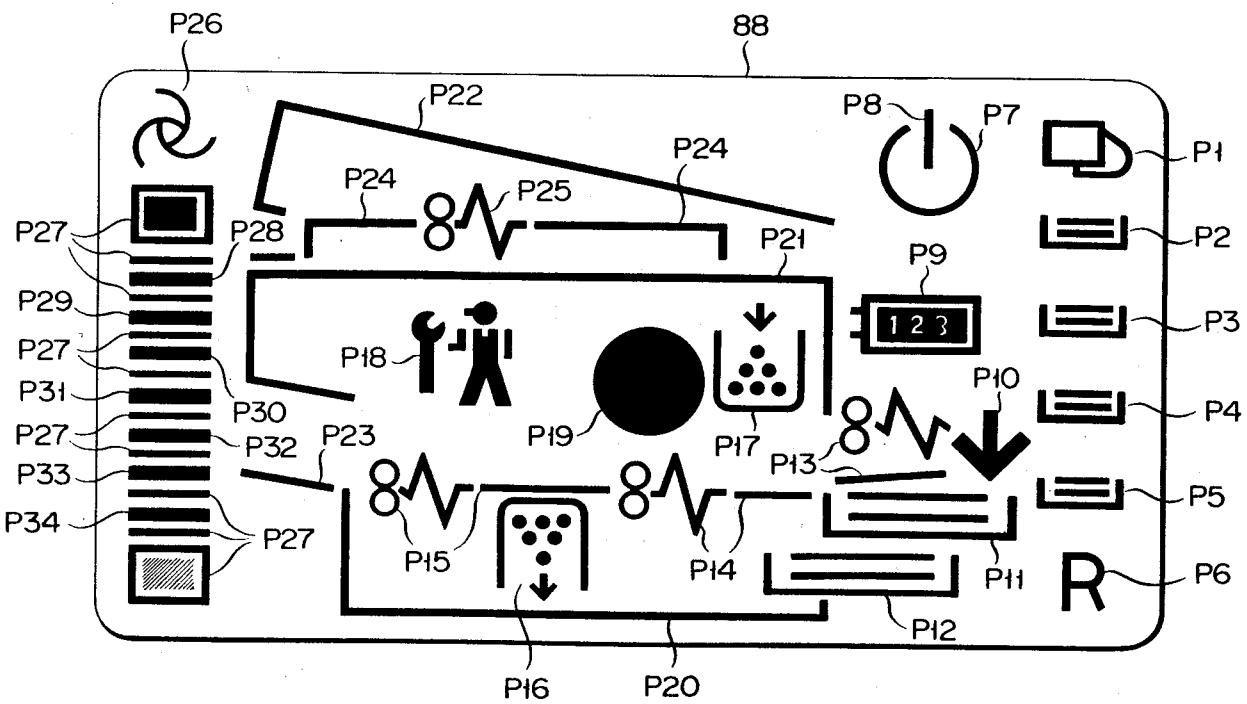
FIG. 5 is a plan view of a liquid crystal display unit in the operation panel.

FIG. 5 shows an arrangement of various display patterns (segments) displayed on the liquid crystal display unit 80 by liquid crystal display elements. A liquid crystal display panel 88 comprises a display pattern P1 for indicating a manual feed enable state, display patterns P2 to P5 for indicating the paper size stored in the selected paper feed cassette with the paper size displays 81, a display pattern ("R") P6 for indicating that the paper sheets are set to be conveyed along a longitudinal direction thereof, display patterns P7 and P8 for indicating the enable and disable states of the copying operation, and the like. When only the display pattern P7 is illuminated, this indicates the copying operation enable state. However, when both the display patterns P7 and P8 are illuminated, this indicates the copying operation disable state. Furthermore, the liquid crystal display panel 88 comprises a display pattern P9 for indicating that a total counter is not mounted, a display pattern P10 for indicating no paper remains in the paper feed cassette, a display pattern P11 for indicating that the manual paper feed cassette is loaded, a display pattern P12 for indicating that one of the paper feed cassettes 22A and 22B is mounted, a display pattern P13 for indicating a paper jam occurring in the manual feed mode, a display pattern P14 for indicating that the paper jam or misfeed occurs near the paper feed unit 21, display patterns P15 for indicating with the display pattern P14 peeling failure from the photosensitive drum 2 and a paper jam at an entrance of the heat rollers 31, a display pattern P16 for indicating that the cleaning unit 29 which receives the toner is full, a display pattern P17 for indicating that the toner hopper 20 is empty, a display pattern P18 for indicating a trouble state, a display pattern P19 for indicating the photosensitive drum 2, display patterns P20, P21 and P22 for indicating the housing 1, a display pattern P23 for indicating the exhaust tray 33, a display pattern P24 for indicating that a document feeder is mounted, a display pattern P25 for indicating that a paper jam occurring in the document feeder, a display pattern P26 for indicating the automatic exposure mode, a display pattern P27 for indicating a level of the copying density, i.e., exposure amount, when the manual exposure mode is selected, and display patterns P28 to P34 for representing the selected copying density in the manual exposure mode. When the display patterns P28 to P34 are selectively illuminated with the display pattern P27, this represents one of seven steps of the copying density.

Figure 6:
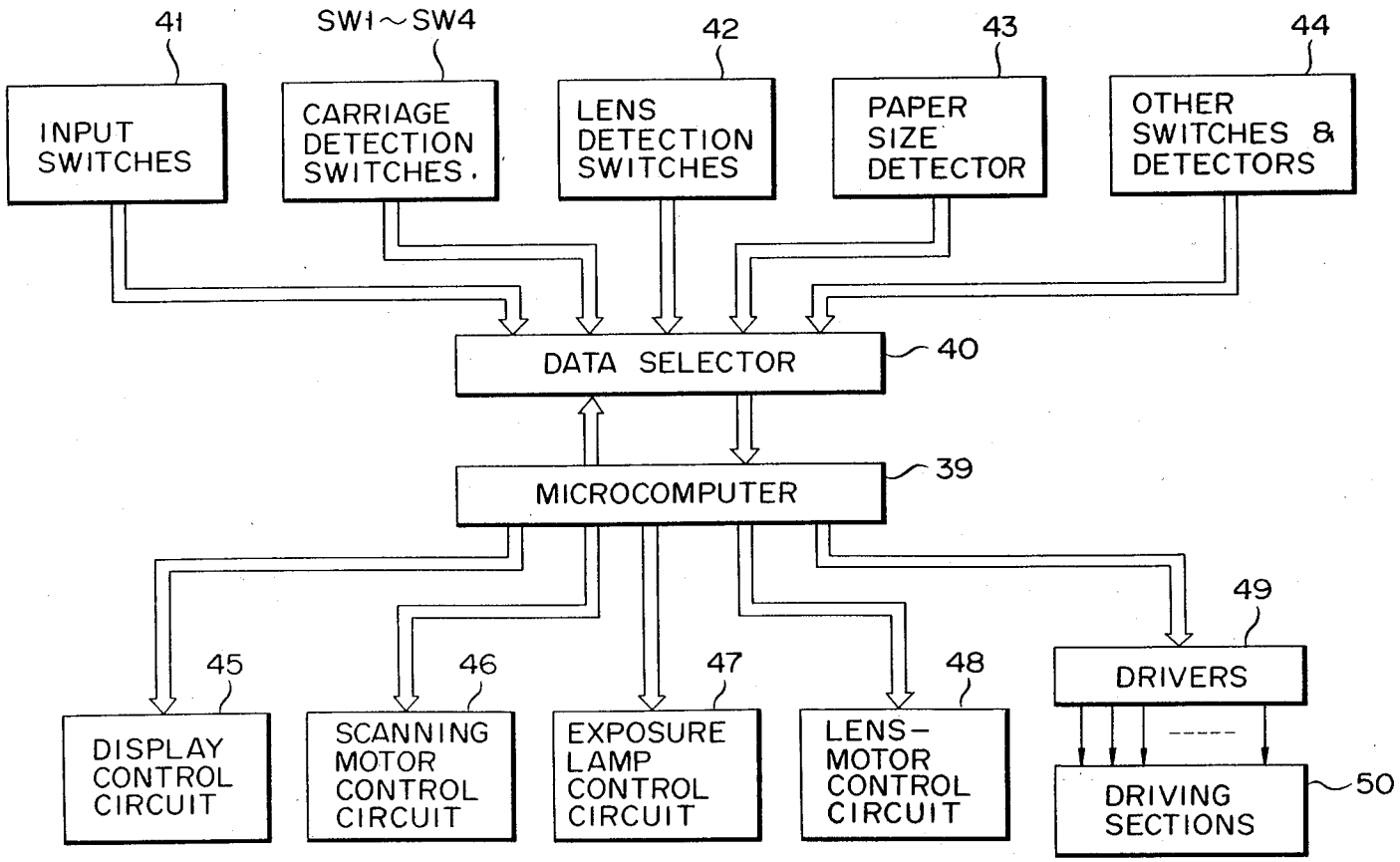
FIG. 6 is a block diagram of an overall control circuit of this embodiment.

FIG. 6 schematically shows the overall control circuit. Reference numeral 39 denotes a microcomputer as a main controller for controlling the overall copying machine. Input switches 41 such as various keys on the operation panel, the carriage detection switches SW1 to SW4, lens detection switches 42 for detecting the position of the main lens $\mathbf{16}_1$, a paper size detector 43 consisting of the microswitches 37 of the paper size detection mechanism and the like, other switches and detectors 44 and the like are respectively connected to an input of the microcomputer 39 through a data selector 40. A display control circuit 45 for controlling the liquid crystal display unit 80 and the various displays on the operation panel, a scanning motor control circuit 46 for controlling a scanning motor for driving the carriages, an exposure lamp control circuit 47 for controlling the exposure lamp 5, and a lens motor control circuit 48 for moving the main lens $\mathbf{16}_1$ are respectively connected to an output of the microcomputer 39. Furthermore, driving sections 50 for the various charger, solenoids and clutches are also connected to the output of the microcomputer 39 through a driver 49.

Figure 7:
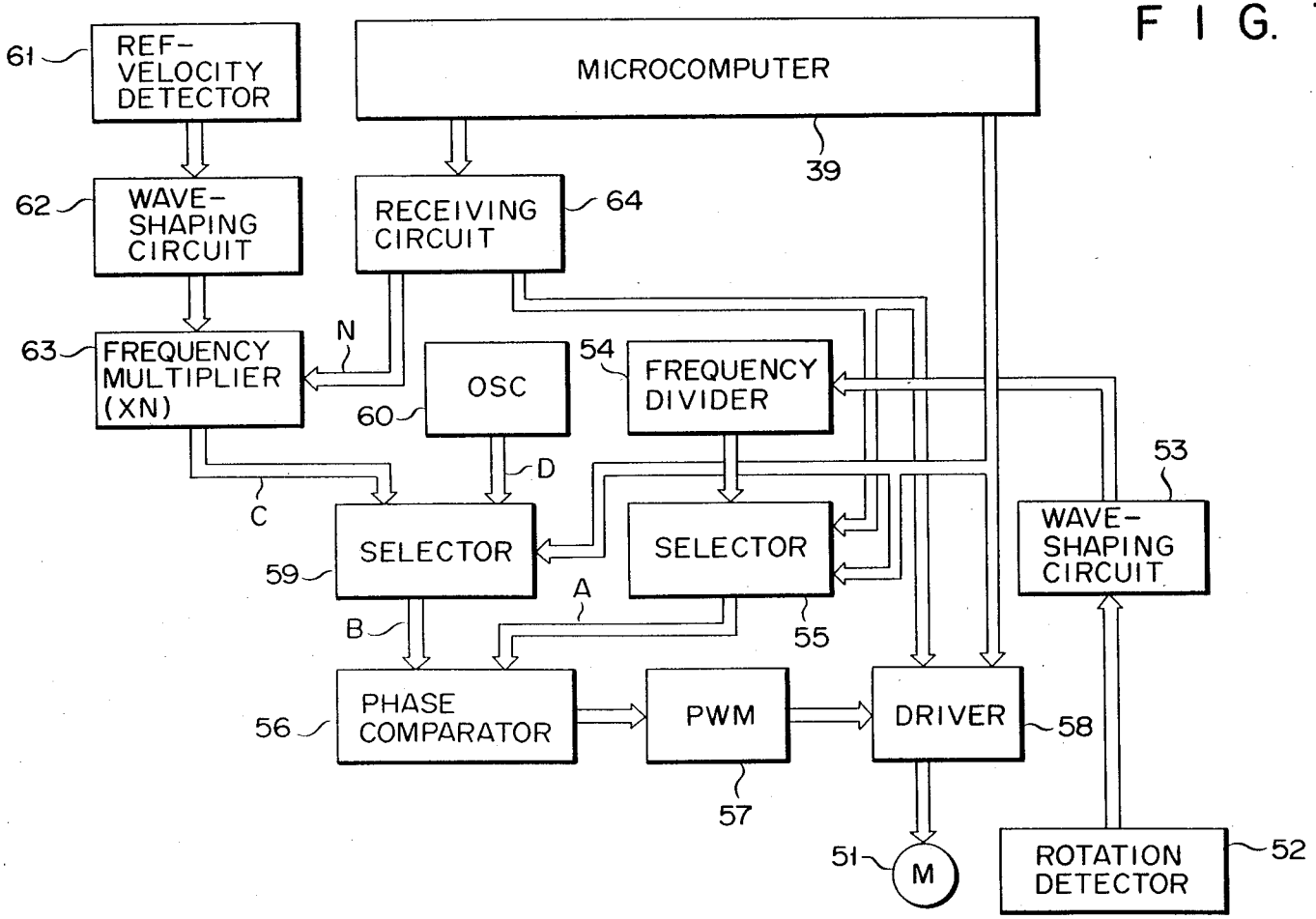
FIG. 7 is a block diagram of a scanning motor control circuit in FIG. 6.

FIG. 7 shows the scanning motor control circuit 46 in more detail. For example, a scanning motor 51 is a DC brushless motor. A rotation detector 52 is provided for detecting the rotational frequency of the motor 51. The rotation detector 52 generates a signal having a frequency proportional to the rotational frequency of the motor 51. The signal from the detector 52 is wave-shaped by a wave-shaping circuit 53 and thereafter is supplied to a frequency divider 54. The frequency divider 54 generates signals having frequencies 1/1, ½ and ¼ that of the input signal, respectively. These three signals are supplied to a selector 55. The selector 55 generates the ½ or 1/1 frequency signal in accordance with a moving speed determined by the current copying magnification when the carriages move forward. The selector 55 generates the ¼ frequency signal when the carriages move backward at a high speed, or generates the 1/1 frequency signal when it is driven in the backward direction at a low speed. An output signal A from the selector 55 is supplied to a phase comparator 56. The comparator 56 detects a phase difference between the signal A and a reference signal B having a reference frequency, and generates an analog voltage corresponding to this phase difference and a polarity thereof. The analog voltage is supplied to a pulse width modulator (PWM) 57. The PWM 57 generates a pulse signal having a pulse width corresponding to the analog voltage. The signal from the PWM 57 is supplied to a driver 58. The driver 58 applies a driving voltage to the motor 51 during an interval corresponding to the pulse width of the output signal of the PWM 57. In other words, an effective value of the driving voltage applied to the motor 51 changes in accordance with the pulse width of the output signal from the PWM 57. In such a feedback loop, the rotational frequency of the motor 51 is controlled to be proportional to the reference signal B.

The reference signal B is the output of the selector 59. When the carriages move forward, a signal C is selected by the selector 59. When the carriages move backward, a signal D having a fixed frequency from an oscillator (OSC) 60 is selected. The signal C is obtained in such a manner that an output signal from a reference velocity detector 61 which generates a signal having a frequency proportional to the rotational frequency of the photosensitive drum 2 is wave-shaped in a wave-shaping circuit 62, and the frequency of the output signal from the circuit 62 is multiplied by N by a PLL frequency multiplier 63. Note that "N" is determined in such a manner that a signal having a plurality of bits which is serially transmitted from the microcomputer 39 is received by a receiving circuit 64 and is converted into parallel data. More specifically, when the copying magnification is assumed to be X %, N can be expressed by $$N=K/X$$

where K is constant, and a decimal part of K/X is rounded. The frequency multiplier 63 sets the scanning speed (moving speed of the carriages) in accordance with the copying magnification.

To summarize, when the carriages move forward, the motor 51 is rotated at a rotational frequency proportional to the frequency N times that proportional to the rotational frequency of the photosensitive drum 2. When the carriages move backward at a high speed, the motor 51 is rotated in the reverse direction at the frequency proportional to that of the oscillator 60. When the carriages move backward at a low speed, the motor 51 is rotated at a rotational frequency ¼ the frequency of the high-speed backward movement in the same direction as that thereof.

Figure 8:
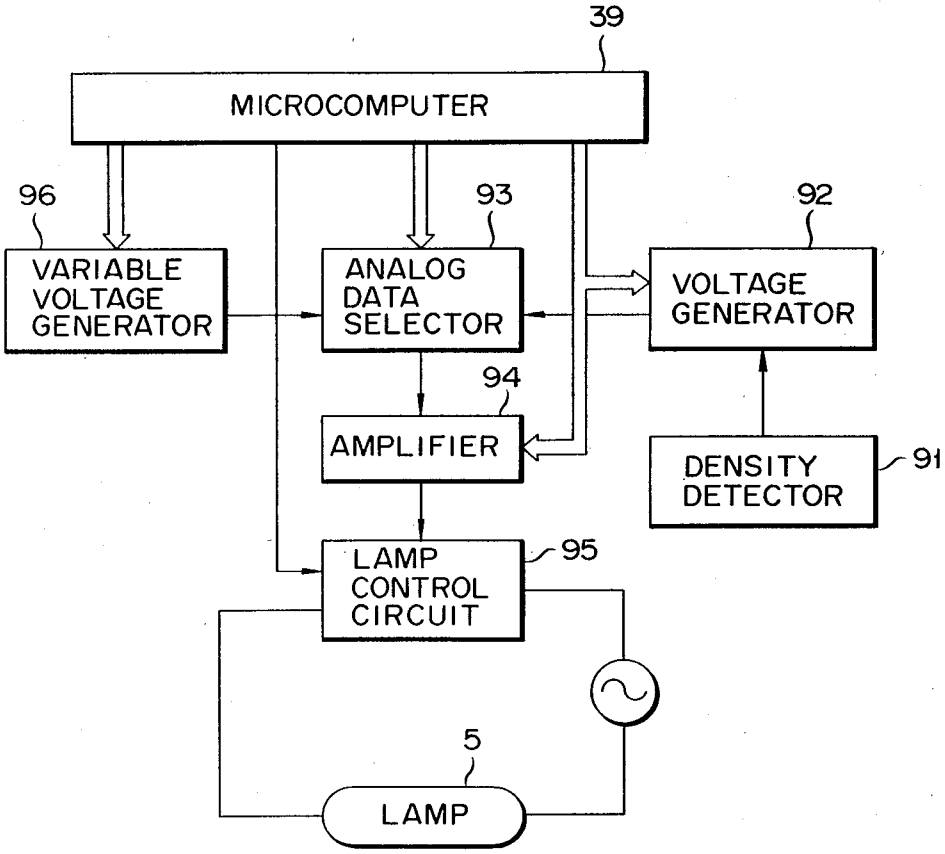
FIG. 8 is a block diagram of an exposure lamp control circuit in FIG. 6.

FIG. 8 schematically shows the exposure lamp control circuit 47 in FIG. 6. In the automatic exposure mode, an amount of light emitted from the exposure lamp 5 and reflected from the document is detected by a density detector 91. The detection signal from the detector 91 is supplied to a voltage generator 92. The voltage generator 92 generates an analog voltage so that when the amount of reflected light is small, a voltage supplied to the exposure lamp 5 is increased, and when the amount of reflected light is large, the voltage is decreased. The output signal from the generator 92 is supplied to an amplifier 94 through an analog data selector 93. The signal amplified by the amplifier 94 is supplied to a lamp control circuit 95 as a reference voltage. As a result, the lamp control circuit 95 controls the voltage supplied to the exposure lamp 5 so that the amount of reflected light from the document becomes constant. In the manual exposure mode, the analog data selector 93 generates a signal received from a variable voltage generator 96. The variable voltage generator 96 can generate one step of a fixed voltage, that is, one step of the seven steps of the fixed voltages is generated in accordance with selection in the manual exposure mode. Therefore, in this case, a predetermined voltage is supplied to the exposure lamp 5 regardless of the density of the document. In three steps of a darker side of the seven steps of the copying density, the change in amounts are small in comparison to the lighter side thereof. The amount of light emitted by the exposure lamp is adjusted in accordance with the selected copying magnification.

Figure 9A:
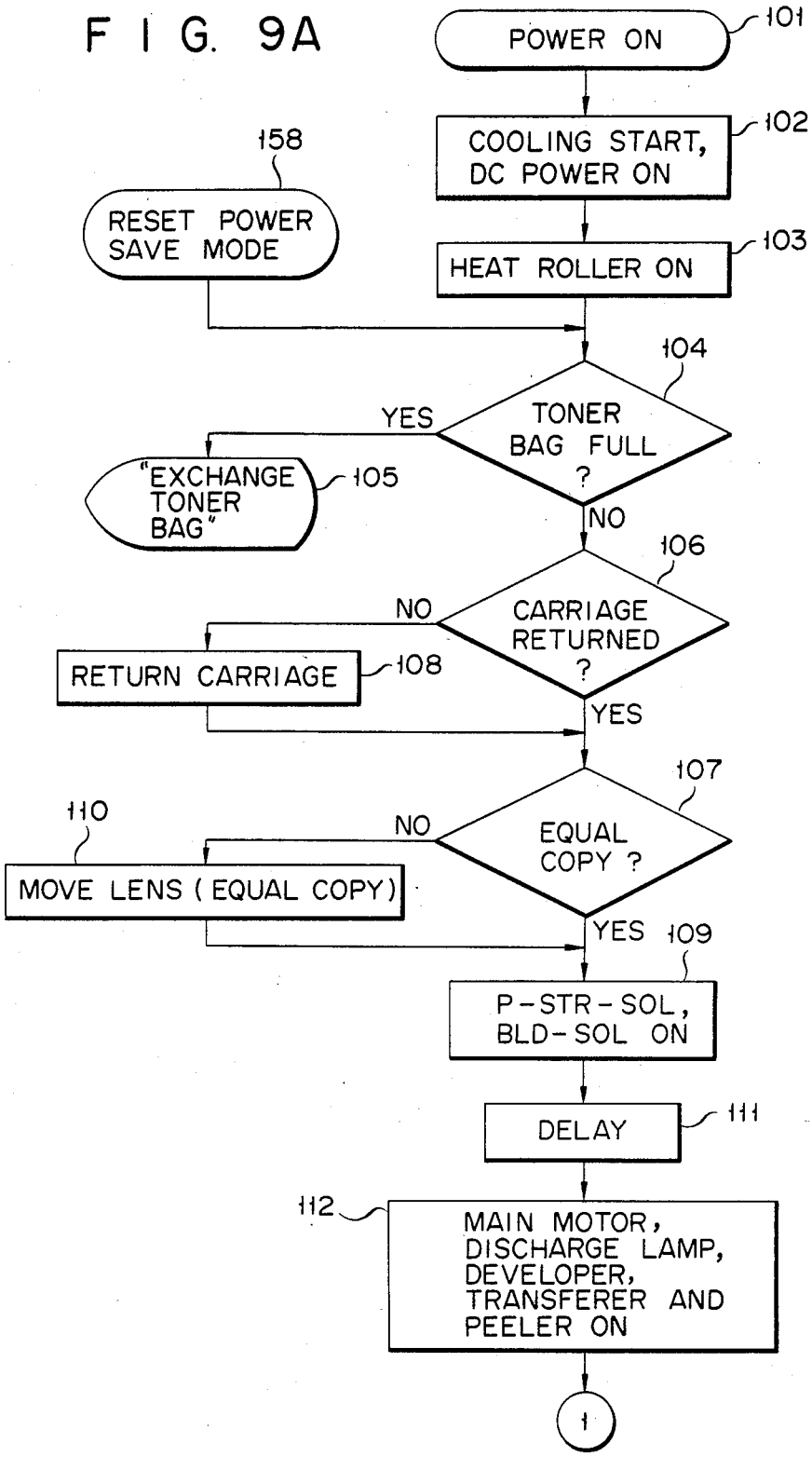
FIGS. 9A and 9B are flow charts showing operation from power ON to the waiting operation mode.
Figure 9B:
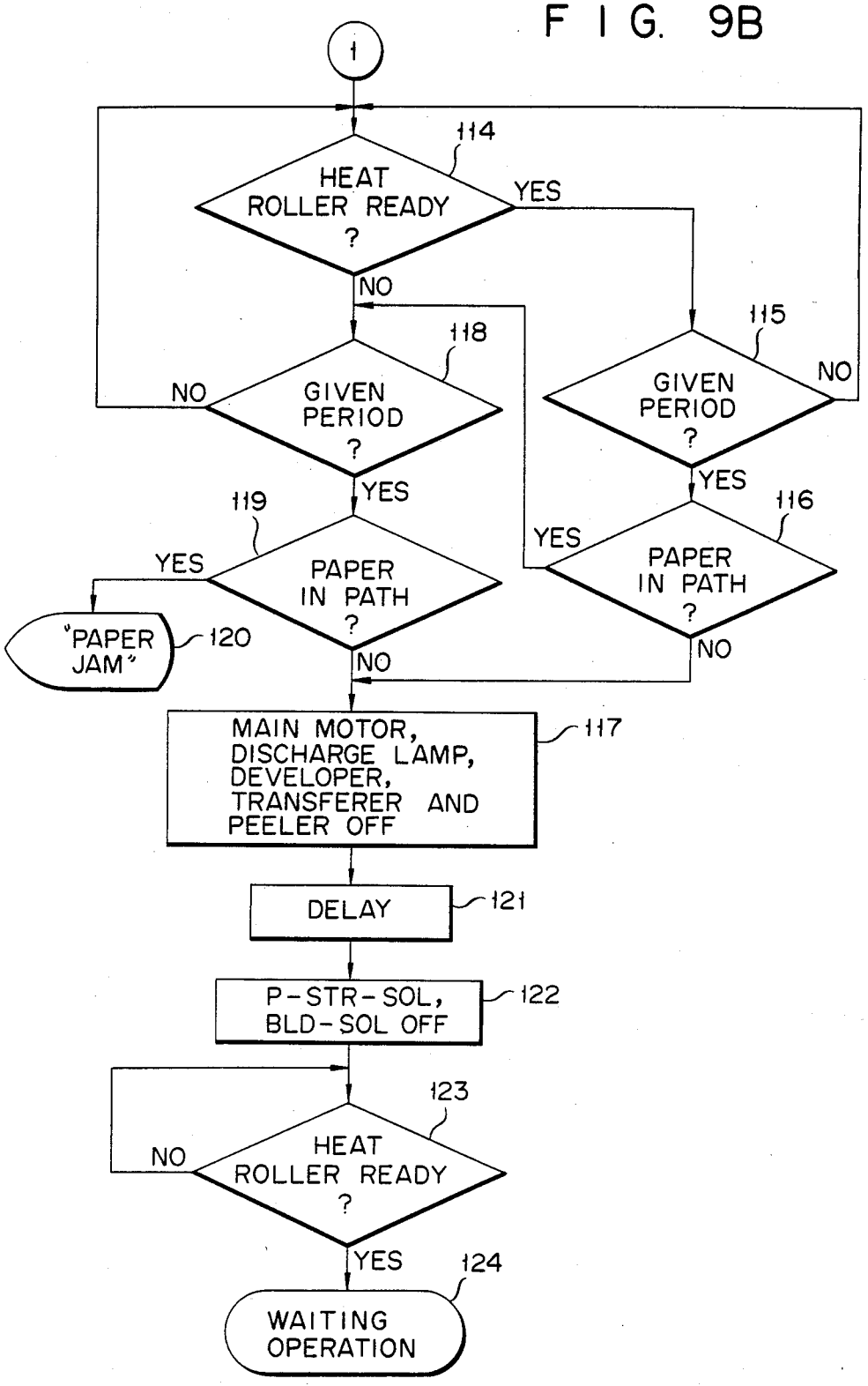

The operation of the embodiment having the above arrangement will be described hereinafter. First, the operation from power ON to the waiting operation mode will be described with reference to flow charts shown in FIGS. 9A and 9B. When the power is turned on in step 101, an exhaust fan (not shown) is turned on so as to cool the inside of the machine and DC power is supplied to the control circuit in step 102. A heater of the heat rollers 31 is turned on, thereby heating them in step 103. Then, the microcomputer 39 determines whether or not a toner bag in the cleaning unit 29 is full by a toner level detector (not shown) in step 104. If YES in step 104, "EXCHANGE TONER BAG" is displayed in step 105. If NO in step 104, the following operation is performed. The microcomputer 39 determines from the operating state of the switch SW1 whether or not the carriages are returned and positioned at the scanning initial position in step 106. If YES in step 106, the flow advances to step 107. If NO in step 106, the carriages are returned to the initial position in step 108, and the flow then advances to step 107. In step 107, the microcomputer determines from the operating state of the position detection switches 42 whether or not the main lens $16_1$ of the lens unit 11 is positioned at the equal copy mode position (or initial position). If YES in step 107, the flow advances to step 109. If NO in step 107, the main lens $16_1$ is returned to the equal mode position in step 110, and thereafter step 109 is executed. In step 109, a paper start solenoid (P-STR-SOL) for controlling the aligning rollers 26 and a blade solenoid (BLD-SOL) for controlling a cleaning blade of the cleaning unit 29 are turned on. Thus, the aligning rollers 26 are rotated and the cleaning blade is urged against the surface of the photosensitive drum 2. After the cleaning blade is operated for a predetermined length of time in step 111, a main motor, the discharger lamp 17, a developing bias, the transfer charger 27 and the peeling charger 28 are respectively turned on in step 112. This state is called a "forced paper exhausting state" and is continued for a predetermined interval (e.g., about seven seconds). If a paper sheet remains on the convey path in the copying machine, it is exhausted onto the exhaust tray 33 during this predetermined interval. In step 114, the microcomputer determines whether or not the heat rollers 31 are heated to a fixing enable temperature. If YES in step 114, the microcomputer determines in step 115 whether or not the predetermined interval has passed from when the main motor was turned on. If YES in step 115, the microcomputer determines whether or not the paper sheet remains on the convey path in step 116. If NO in step 116, the flow advances to step 117. If YES in step 116, the microcomputer determines in step 118 whether or not the predetermined interval has passed from when the main motor was turned on. If YES in step 118, the microcomputer in step 119 determines again whether or not the paper sheet remains on the convey path. If YES in step 119, "PAPER JAM" is displayed in step 120. If NO in step 119, step 117 is executed. In step 117, the main motor, the discharger lamp 17, the developing bias, the transfer charger 27 and the peeling charger 28 are respectively turned off. After a sufficient time during which the main motor has been stopped (step 121), the BLD-SOL and the P-STR-SOL are turned off in step 122. Thereafter, the microcomputer determines whether or not the heat rollers 31 are ready in step 123. If YES in step 123, the copying machine is placed in the waiting mode in step 124.

Figure 10A:
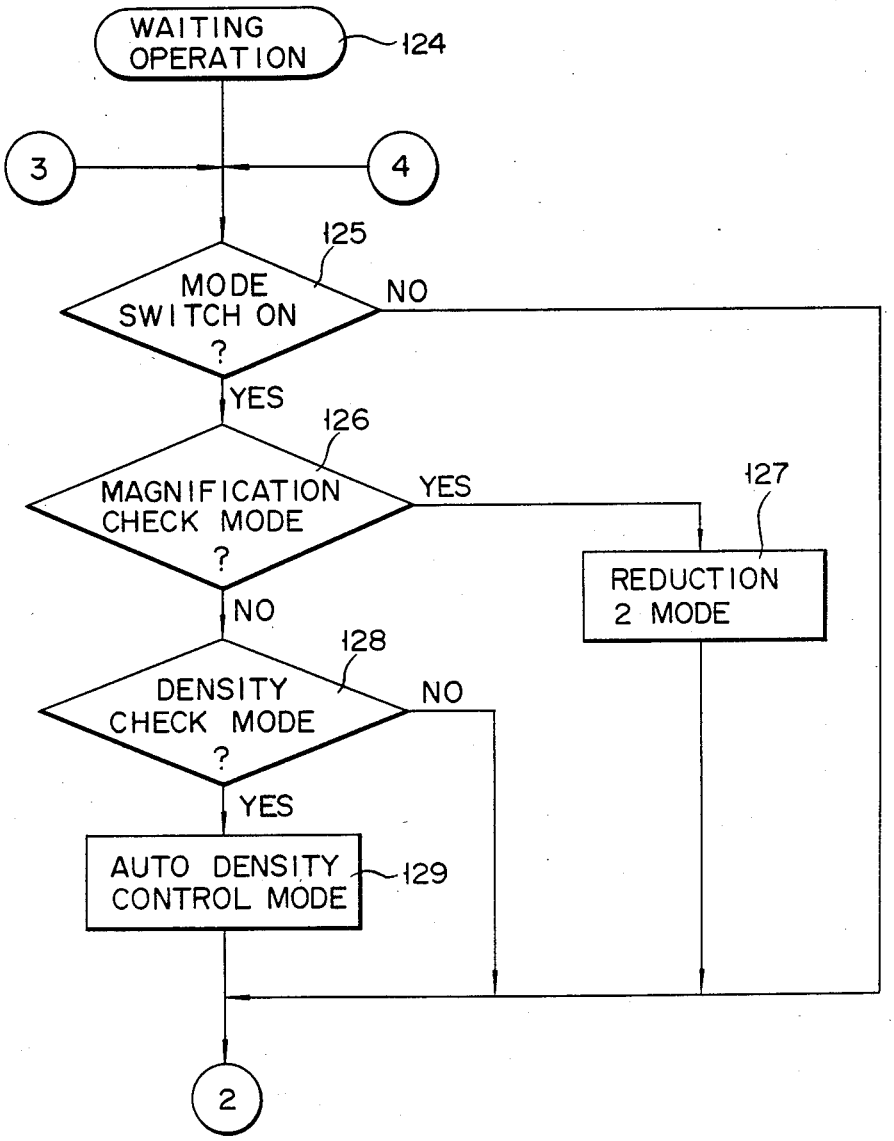
FIGS. 10A and 10B are flow charts illustrating the waiting operation mode until the copying operation starts.
Figure 10B:
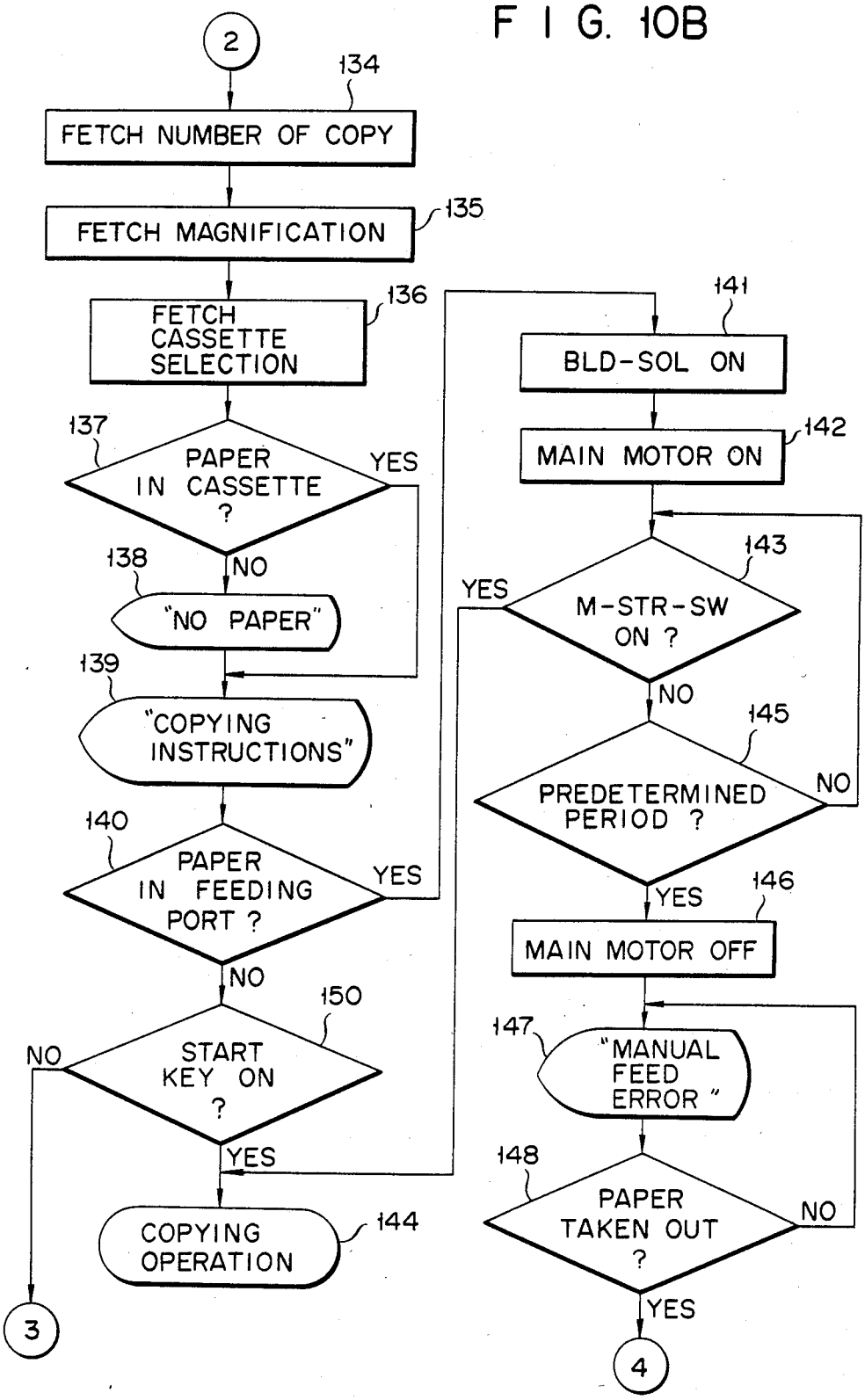

A waiting operation before the copying operation starts will be described with reference to the flow charts shown in FIGS. 10A and 10B. In step 125, it is checked whether or not the mode changing switch (not shown, but provided on a printed circuit board in which the control circuit is built) is turned on. If NO in step 125, the flow jumps to step 134, to be described later, for fetching the copying number. If YES in step 125, the microcomputer determines whether or not the magnification check mode is set in step 126. Note that the magnification check mode is set by simultaneously depressing a specific combination of the copy number keys 76 on the operation panel, for example, "0" and "3". If YES in step 126, the microcomputer 39 sets the copying magnification in the reduction 2 mode in step 127, and the flow advances to step 134 for fetching the copying number. On the other hand, if NO in step 126, the microcomputer determines in step 128 whether or not the copying density check mode is set. Note that the copying density check mode can be set by simultaneously depressing a specific combination of the copy number keys 76 on the operation panel, for example, "0" and "4". Therefore, when these two keys are depressed simultaneously, the microcomputer 39 first sets the exposure mode in the automatic exposure mode or the automatic density control mode in step 129, and the flow then jumps to step 134 for fetching the copying number. On the other hand, if NO in step 128, the flow directly jumps to step 134 for fetching the copying number.

In steps 134 to 136, the fetching operation of the copying number, the copying magnification and density and the cassette selection are performed. The copying number is set by the ten keys 76 in step 134. When the copying number is set, the set value is displayed on the copying number display 78 and is stored in the memory (RAM1) in the microcomputer 39. When the copying operation is interrupted by the clear/stop key 77, the copying number display 78 displays the remaining copying number. When the preset number of the copying operation is completed, the copying number display 78 displays the value stored in the memory in the microcomputer 39 again. The copying number varies in each case. Therefore, if no operation is performed for a predetermined period of time, the copying number is automatically reset to be 1 for convenience. In the copying magnification fetched in step 135, the equal copying mode is most frequently used. For this reason, when power is ON or when no copying operation is performed for a predetermined period of time, the copying magnification is reset to be the equal copying mode as the standard state. The copying density is controlled in the following two modes. An automatic exposure mode for automatically copying at the optimum density regardless of the density of the document and a manual exposure mode for copying the desired density are provided for setting the copying density. In the manual exposure mode, seven steps of copying density can be selected by the lighten key 83 and the darken key 84. In the automatic exposure mode, when the lighten key 83 or the darken key 84 is depressed, the operation mode is changed into the manual exposure mode. At this time, the central step of the seven steps is selected and the display pattern P31 is illuminated. In this case, when the lighten key 83 is depressed, every one depression changes the copying density to the lighter side thereof by one step. When the lighten key 83 is kept depressed for longer than a predetemined period of time, the copying density is changed to the lighter side. The darken key 84 is operated in the same manner as in the lighten key 83. In accordance with such key operations, the display patterns P28 to P34 are selectively illuminated and indicate the selected copying density (exposure amount). When the automatic exposure key 82 is depressed, the automatic exposure mode is selected. Most copying operations can be performed in the automatic exposure mode. Therefore, the manual exposure mode is used only for copying a specific document. For this reason, when power is ON or when no copying operation is performed after a predetermined period of time, the automatic exposure mode is automatically selected.

In cassette selection (step 136), either the upper or lower cassette is selected. The manual paper feed operation is performed by inserting the paper sheets in the manual paper feed port regardless of this cassette selection. When the cassette selection is performed in this manner, the microcomputer determines whether or not paper sheets are stored in the cassette, in step 137. If NO in step 137, "NO PAPER" is displayed in step 138. If YES in step 137 or when the paper sheets are supplied, "COPYING INSTRUCTIONS" is displayed in step 139. Then, in step 140, the microcomputer determines whether or not paper sheets are inserted in the manual paper feed port 24, thereby determining whether or not the manual paper feed operation starts. If YES in step 140, the BLD-SOL is turned on in step 141. Thereafter, in step 142, the main motor is turned on. At this time, since the P-STR-SOL is kept off, the paper feed roller 25 is rotated and the aligning rollers 26 are stopped. For this reason, the paper sheet is fed to the aligning roller 26 by the paper feed rollers 25. In step 143, when the microcomputer detects that a manual start switch (M-STR-SW) is turned on by this manual paper feed operation, the flow advances to step 144 of the copying operation (to be described later). When the main motor is not rotated longer than the predetermined interval after the M-STR-SW is turned on, "MANUAL FEED ERROR" is displayed and the main motor is turned off, thereby indicating this condition to a user. When the microcomputer detects in step 143 that the M-STR-SW is not turned on, the microcomputer determines whether or not the predetermined period of time has elapsed from when the main motor was turned on in step 145. After the predetermined period of time, the main motor is turned off in step 146. In step 147, "MANUAL FEED ERROR" is displayed so as to indicate that the paper sheets should be removed from the manual paper feed port. In step 148, the microcomputer detects that the paper sheets have been removed from the manual paper feed port, and the flow returns to step 125. On the other hand, If NO in step 140, the microcomputer determines in step 150 whether or not the copying key is turned on. If YES in step 150, the flow advances to copying operation step 144. If NO in step 150, the flow returns to step 125 and the checking operation of an error in the housing is repeated.

The copying operation (step 144) will be described with reference to the flow charts shown in FIGS. 11A to 11E. When the copying key 71 is turned on (step 161), the BLD-SOL and the P-STR-SOL are turned on and the cleaning blade is urged against the surface of the photosensitive drum 2 in step 162. After a sufficient period of time for operating the cleaning blade passes in step 163, the main motor, discharger lamp 17, the developing bias, the transfer charger 27 and the peeling charger 28 are respectively turned on in step 164. After a predetermined period of time has elapsed in step 165, the exposure lamp 5 is then turned on in step 166. During this interval, the microcomputer determines whether or not the carriages are positioned at the initial position in step 167. Since the housing 1 is split into upper and lower casings having the convey path 30 at a boundary, if a paper jam and the like occurs in the convey path 30 and the upper casing 1*a* is opened, the carriages may be shifted from the initial position. Therefore, if NO in step 167, the carriages are returned to the initial position in step 168. The carriages are returned at a low speed in steps 169 and 170. After a predetermined time has elapsed in step 171 after step 166, the P-STR-SOL is turned off and the aligning roller 26 is stopped in step 172. In step 173, the paper feed operation from the selected cassette is performed and a paper sheet is fed to the aligning rollers 26. In the manual paper feed mode, this paper feed operation is omitted. In step 174, the charger 18 is turned on, thereby charging the photosensitive drum 2. In step 175, the carriages move along the direction indicated by the arrow b in FIG. 1 in response to a carriage forward signal, thus starting the document scanning operation. In step 176, the microcomputer determines whether or not the switch SW2 is turned on. If YES in step 176, a predetermined period of time in accordance with the selected copying magnification elapses in step 177. In step 178, the P-STR-SOL is turned on and the aligning rollers 26 are rotated so as to feed the paper sheet to the transfer unit such that the position of the image formed on the photosensitive drum 2 is aligned with that of the paper sheet.

If NO in step 176, the microcomputer determines whether or not a predetermined period of time has elapsed in step 179. If YES in step 179, this indicates a breakdown and "CALL SERVICEMAN" is therefore displayed on the liquid crystal display panel in step 180.

After the P-STR-SOL is turned on, an exhaust switch (EXT-SW) front timer is turned on which thereby starts counting in step 181. In step 182, the displayed number is decremented by one. Thereafter, in step 183, the microcomputer determines whether or not the paper sheet has reached the aligning rollers 26. If NO in step 183, "PAPER JAM" is displayed in step 184. If YES in step 183, a total counter and a key counter are turned on during 100 ms and a total copying number is incremented in step 185.

The document is scanned by movement of the carriages. The reflected light from the document is irradiated on the photosensitive drum 2 through the mirrors 6, 9 and 10, the lens unit 11, and the mirrors 12, 13 and 14 so that an electrostatic latent image corresponding to an image on the document is formed on the photosensitive drum 2. The latent image is coated with toner by the developing unit 19 so as to form the toner image. The toner image is transferred by the transfer charger 27 to the paper sheet. The paper sheet having the toner image thereon is peeled from the photosensitive drum 2 by the peeling charger 28 and is fed to the heat rollers 31 by the convey unit 30 so as to fix the image thereon. The fixed paper sheet is exhausted by the exhaust roller 32 onto the exhaust tray 32 outside the housing 1. The residual toner on the drum 2 is cleaned by the cleaning unit 29. The photosensitive drum 2 is discharged by the discharger lamp 17, thus preparing it for the next copying operation. During the copying operation, when the microcomputer detects that the carriages has reached the limit position (step 186), the charger 18 is turned off in step 187. When carriages do not reach the limit position within a predetermined period of time after the P-STR-SOL is turned on (step 188), this indicates a problem with the carriages and "CALL SERVICEMAN" is then displayed.

When the paper sheet is fed by the aligning rollers 26, a paper detector detects the trailing end of the paper (step 190). Then, the charger 18 is turned off, thereby stopping the charging of the photosensitive drum 2 in step 191. After a predetermined period of time has elapsed in step 192, the carriages move backward along the direction indicated by the arrow c in FIG. 1 in response to a carriage backward signal and are returned to the initial position. In step 194, the microcomputer checks the toner density in the developing unit 19. If YES in step 194, a toner solenoid (TNR-SOL) for driving the toner supply mechanism of the toner hopper 20 is turned on for a predetermined time period so as to supply toner to the developing unit 19 in step 195. After a predetermined period of time has elapsed after the carriages start to move backward (step 196), the exposure lamp 5 is turned off in step 197. The carriages stop moving when they reach the scanning initial position. In the continuous copying mode, when the carriages move backward and turn on the switch SW2, the flow returns to step 166 and the same operation is repeated.

Figure 11A:
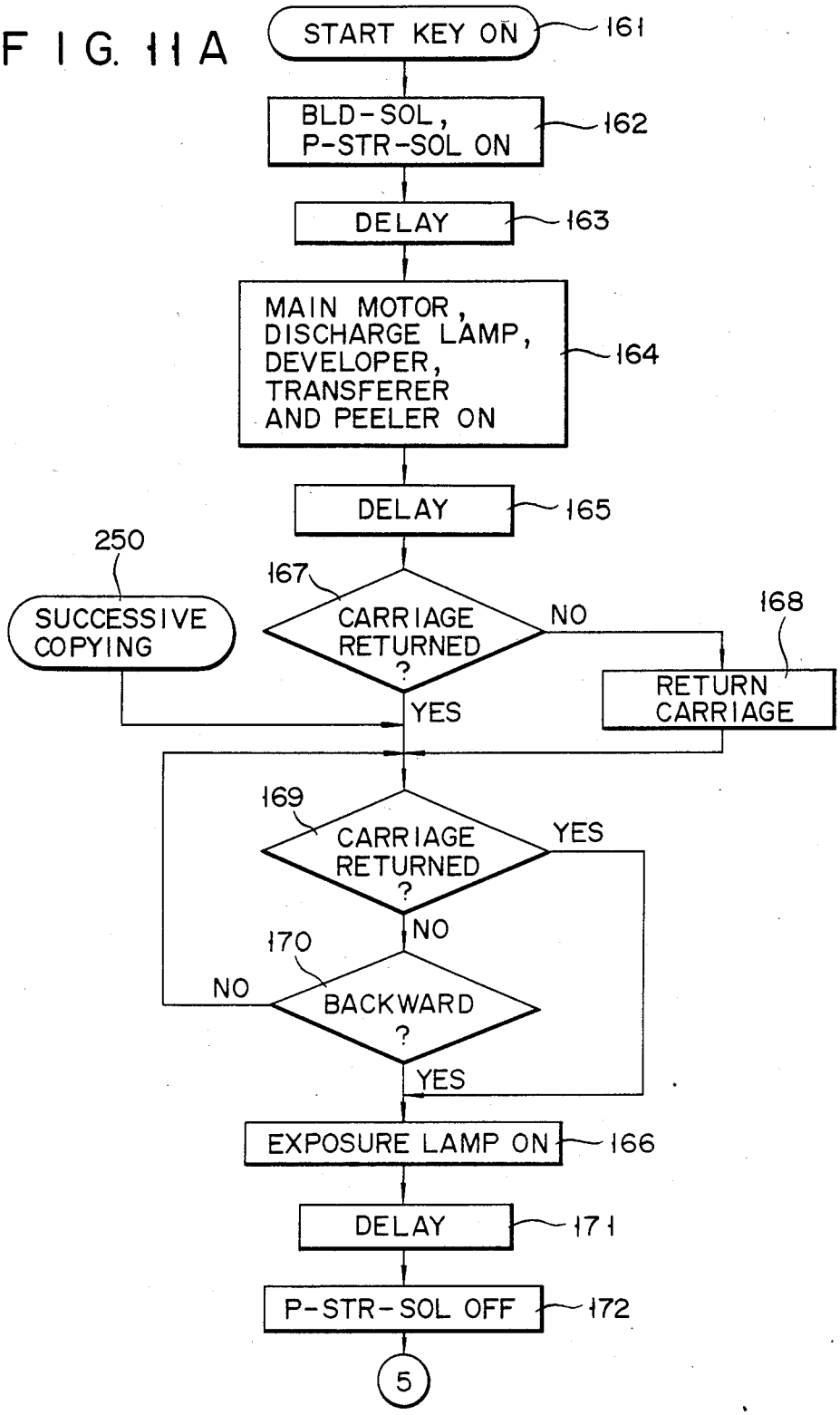
FIGS. 11A to 11E are flow charts illustrating the copying operation procedure initiated after a start key is depressed.
Figure 11B:
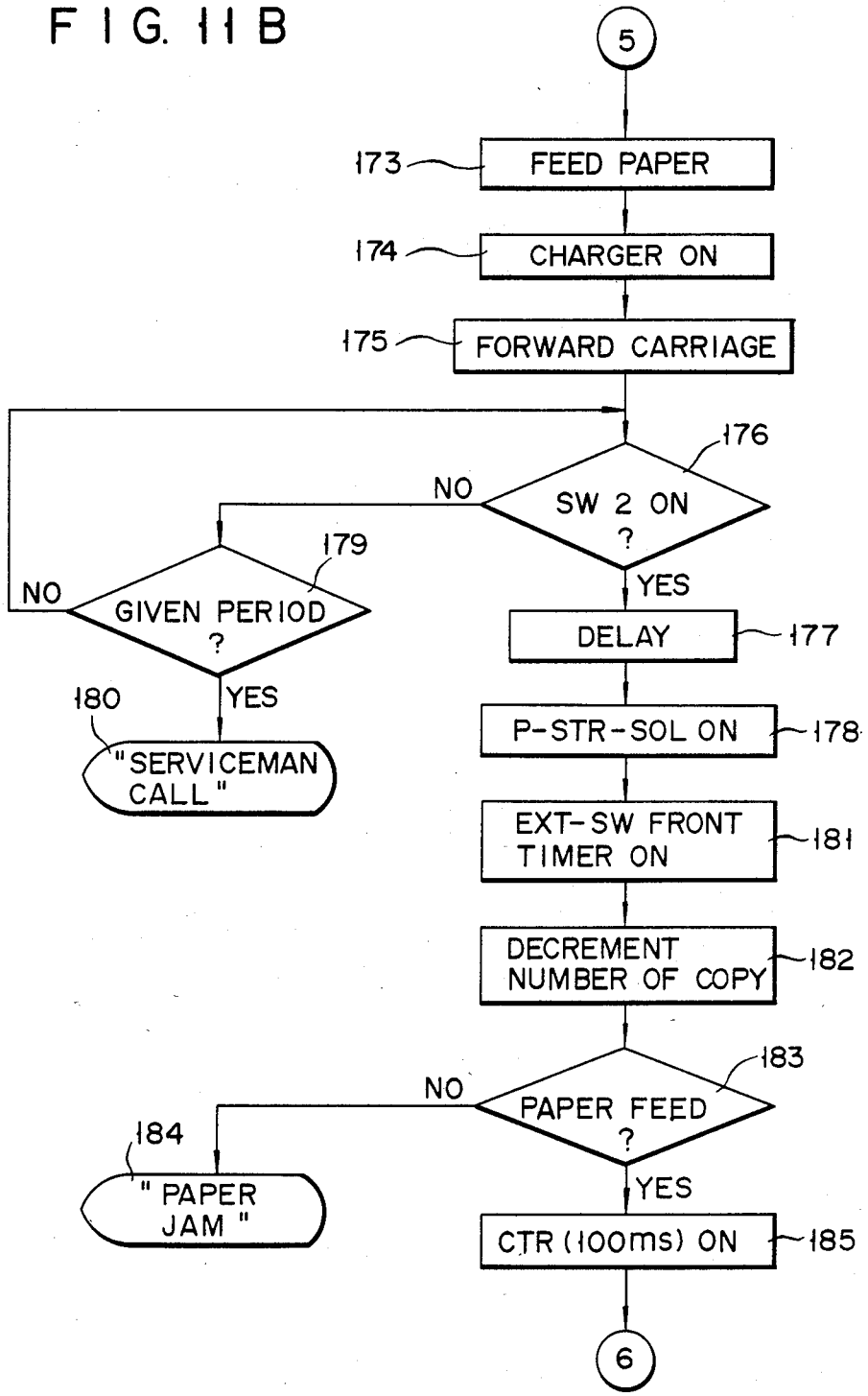
Figure 11C:
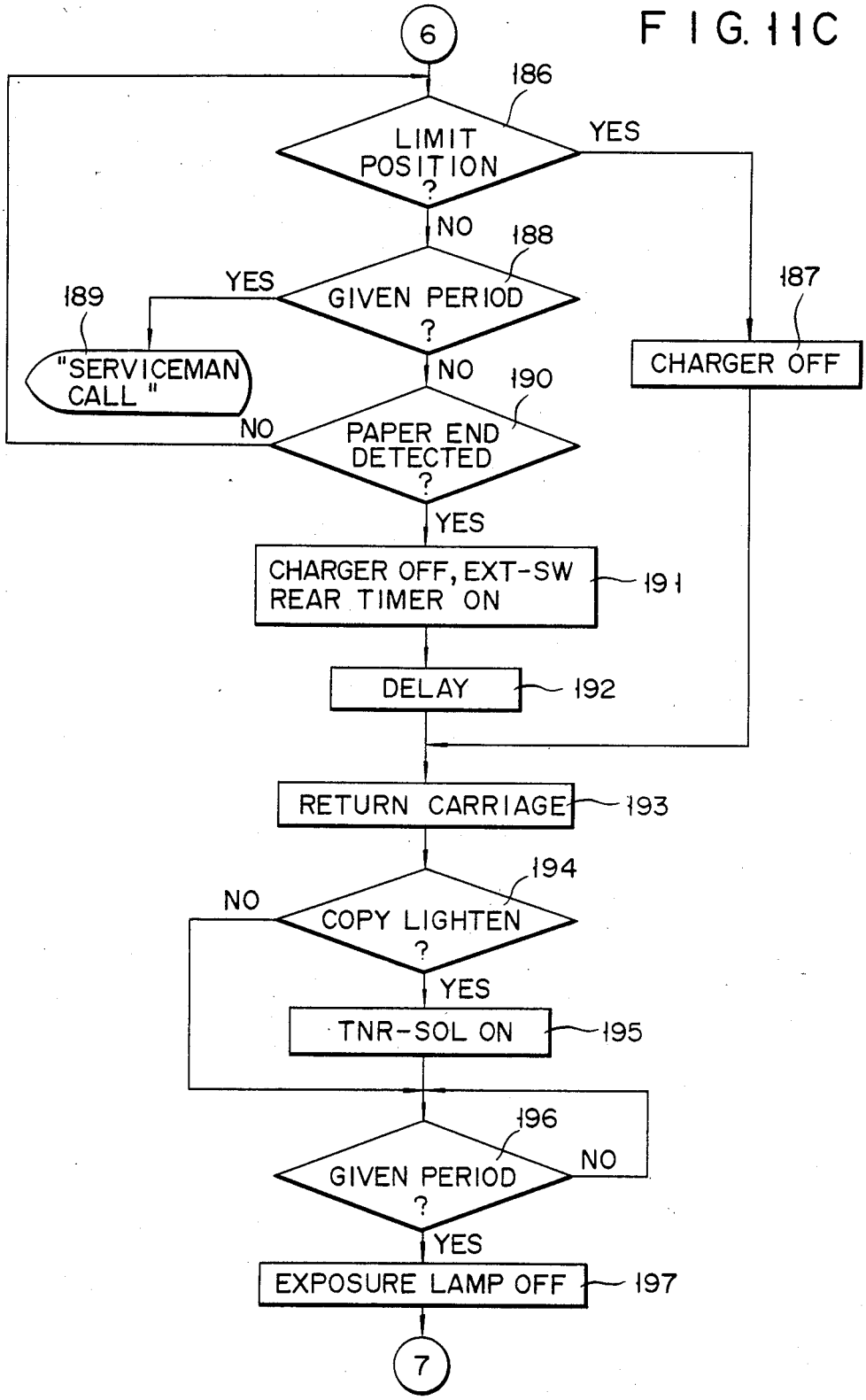
Figure 11D:
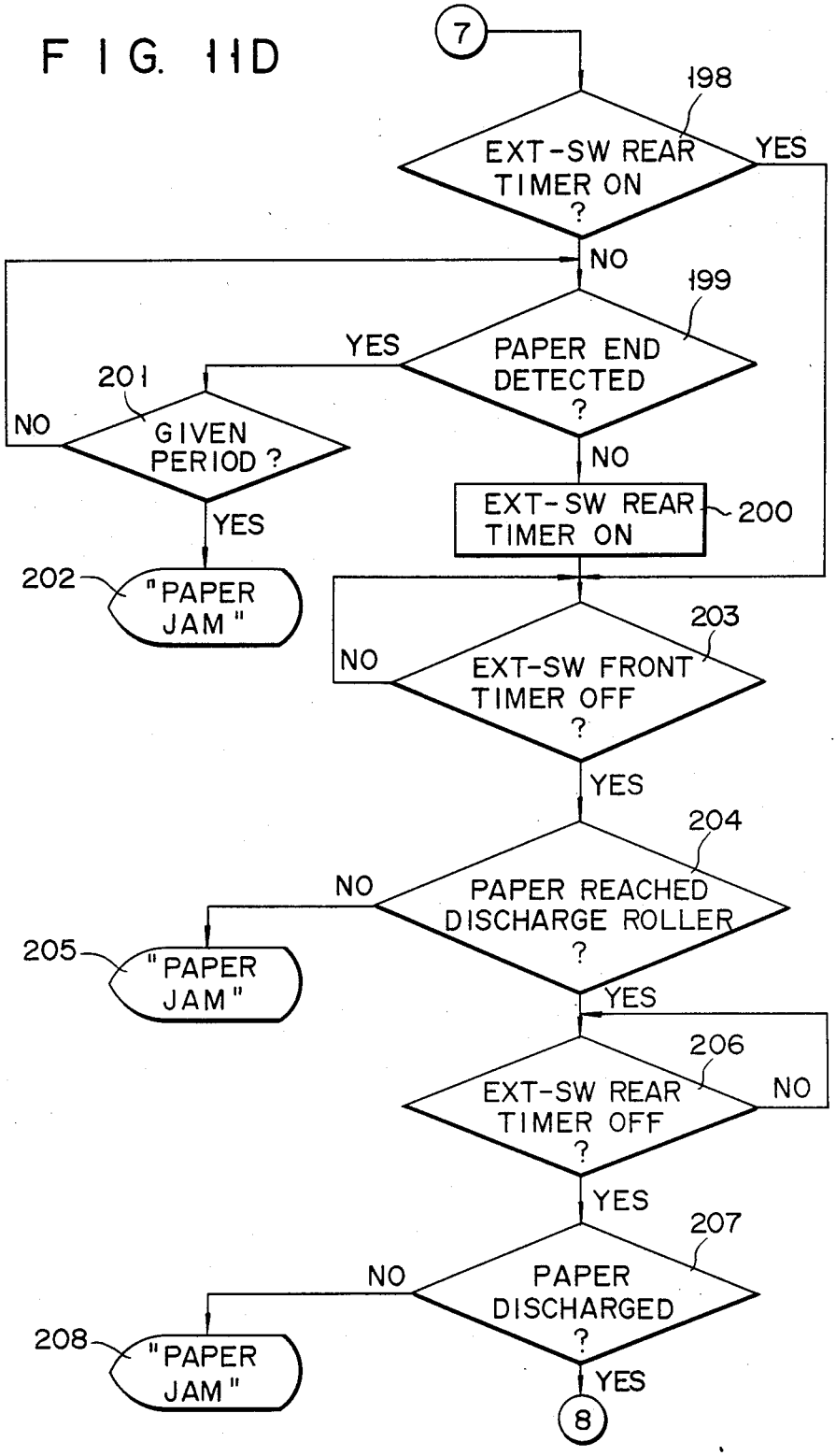
Figure 11E:
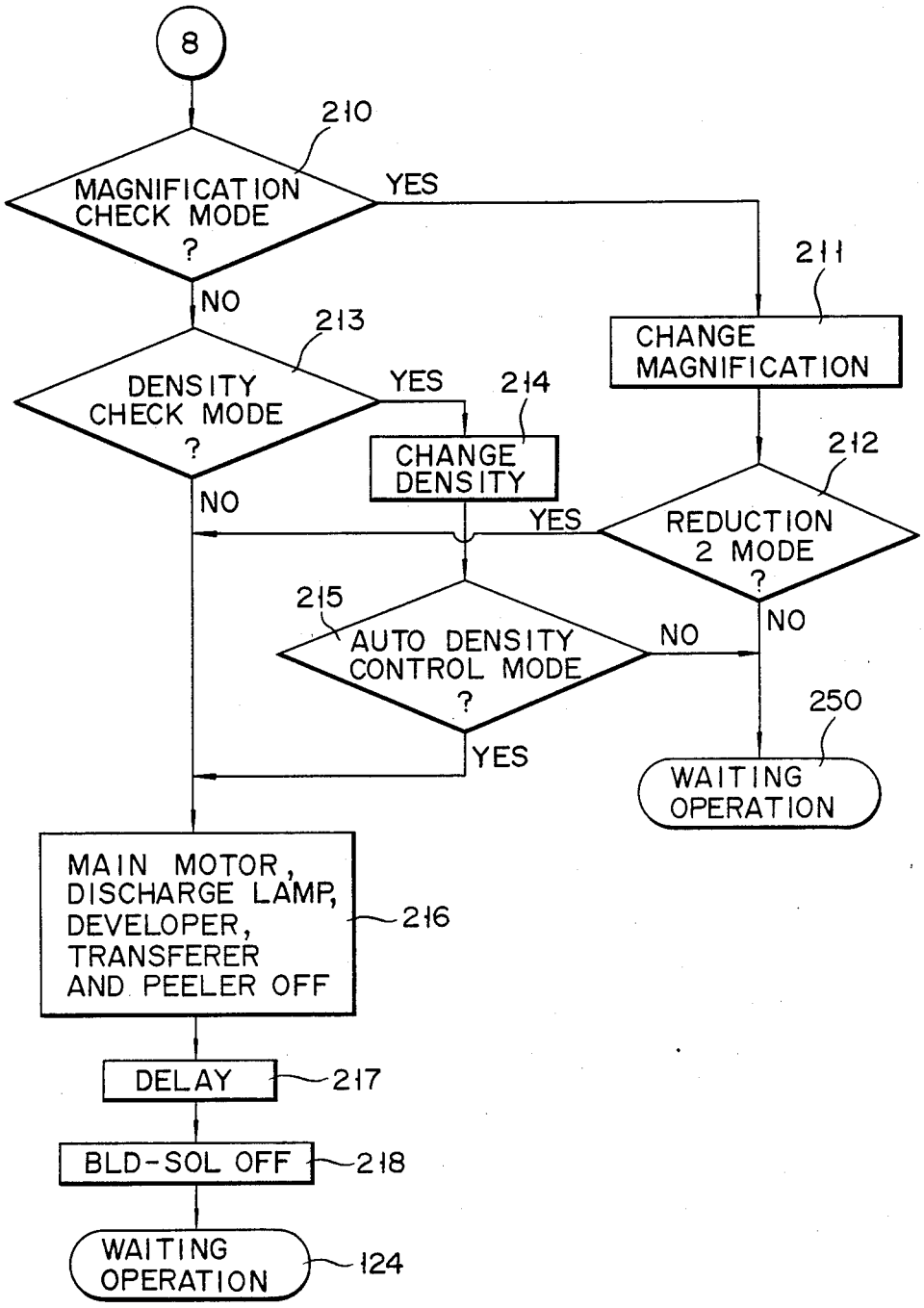
Figure 12:
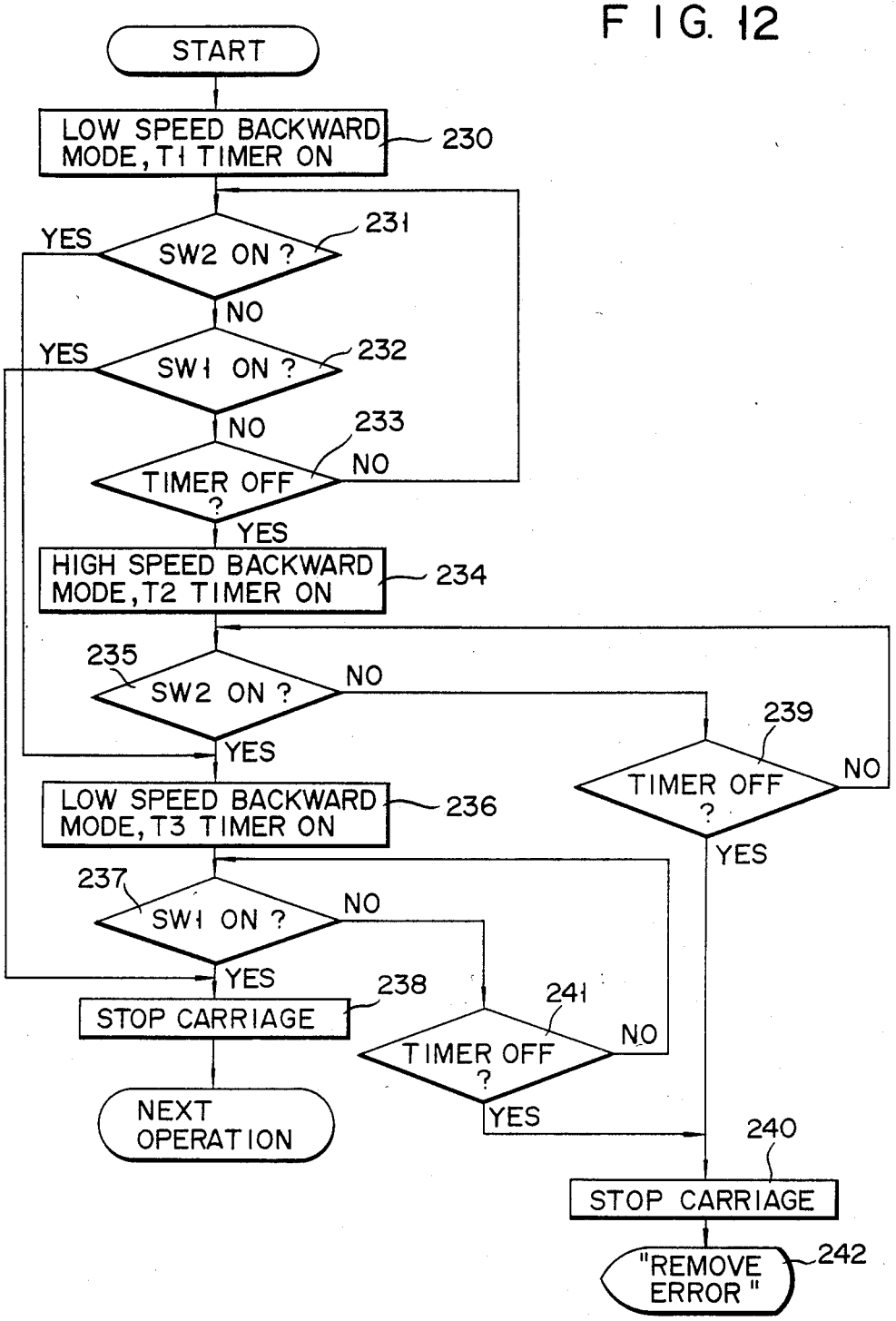
FIG. 12 is a flow chart illustrating how carriages return to an intial position after completing the copying operation.

When one or a preset number of the copying operation is finished, the microcomputer checks the operating state of the EXT-SW provided adjacent to the exhaust roller 32 to see whether or not a paper jam has occurred, as shown in FIG. 11D. If a paper jam is detected by this checking operation, "PAPER JAM" is displayed. If no paper jam is detected, the main motor, discharger lamp 17, developing bias, the transfer charger 27, and the peeling charger 28 are respectively turned off. The main motor is stopped after a predetermined period of time, the BLD-SOL is turned off and the flow returns to step 124 (i.e., the waiting mode).

When a paper jam is detected, the microcomputer displays "PAPER JAM". Meanwhile, when no paper jam is detected, the microcomputer, in step 210 of FIG. 11E, determines whether or not the magnification check mode is set. If YES in step 210, the copying magnification is changed in step 211 to the next value, and it is checked in step 212 whether or not the copying magnification is set in the reduction 2 mode. If NO in step 212, the operation starting from turning on the exposure lamp 5 (from step 169 of FIG. 11A) described above is repeated. On the other hand, if NO in step 210, the microcomputer determines in step 213 whether or not the copying density check mode is set. If YES in step 213, the exposure mode is switched to the next mode in step 214, and it is checked in step 215 whether or not the exposure mode is set in the automatic exposure mode or the automatic density control mode. It should be noted that the exposure mode mentioned in step 214 is cyclically set as follows: the automatic exposure mode setting the copying density at the darkest value in the manual exposure mode→changing the copying density from the darkest value to the lighter side by one step in the manual exposure mode → . . . →setting the copying density at the lightest value in the manual exposure mode→the automatic exposure mode→ . . . If NO in step 215, the operation starting from the above operation of turning on the exposure lamp 5 is repeated. Meanwhile, if YES in step 212, or if NO in step 213, or if YES in step 215, the main motor, the discharger lamp 17, the developing bias, the transfer charger 27, and the peeling charger 28 are respectively turned off in step 216. Then, in step 217, after a predetermined period of time has elapsed, when the main motor is completely stopped, the blade solenoid is turned off in step 218, and the operation mode is set in the waiting operation mode in step 124.

In this manner, when the "0" and "3" keys of the keys 76 are simultaneously depressed, the magnification check mode is set, and the copying magnification is set in the reduction 2 mode. In this state, when the copying key 71 is depressed, the copying operations are continuously and sequentially performed once in the reduction 2 mode (71%), the reduction 1 mode (82%), the equal mode (100%), the enlargement 1 mode (122%) and the enlargement 2 mode (141%). When the copying magnification returns to the reduction 2 mode, the copying operation is stopped. Similarly, when the "0" and "4" keys of the keys 76 are depressed simultaneously, the copying density check mode is set, and the exposure mode is set in the automatic exposure mode. In this state, when the copying key 71 is depressed, the copying operations are continuously and sequentially performed once in the automatic exposure mode, the manual exposure 6 mode (lighten), the manual exposure 4 mode (intermediate value), and the manual exposure 2 mode (dark). When the exposure mode is returned to the automatic exposure mode, the copying operation is stopped. These continuous copying modes are for checking by a service man and for the manufacturing process. For this reason, the above-mentioned mode changing switch is provided so that a user does not set this mode, and an accidental setting of this continuous copying mode can be inhibited by this switch.

The movement control operation of the carriages will be described hereinafter. The four modes of the carriages, i.e., the forward, high-speed backward, low-speed backward, and stop modes are encoded in 2-bit signals, respectively, and the microcomputer 39 supplies these signals to the scanning motor control circuit 46. The scanning motor control circuit 46 decodes these signals, thereby driving the scanning motor 51 through the driver 58. When the 2-bit signal disappears between the microcomputer 39 and the scanning motor control circuit 46, the stop mode is set. The forward mode is used only during the copying operation, that is, when the document is scanned. The forward speed is set in such a manner that data calculated in accordance with the selected copying magnification is used as speed data and is supplied from the microcomputer 39 to the scanning motor control circuit 46 in addition to the above 2-bit signal described above.

Two backward operations are provided. During the copying operation, when the scanning operation of the document ends, the high-speed mode is set, thereby returning the carriages to the scanning initial position at high speed. In this case, in order to increase a copying speed, the high-speed backward speed is about twice that of the maximum forward speed. Even if the stop signal is supplied, a free running distance becomes relatively long due to the inertia of the scanning motor and the carriages. Therefore, if the carriages are kept moving near the initial position at high speed and the stop signal is supplied at this time, the carriages move to the limit position by the inertia thereof and are crushed. In order to prevent this, in this embodiment, the switch SW2 is positioned in such a way that it is turned on when the carriages return to a position slightly before the initial position. When the switch SW2 is turned on during the high-speed backward mode, the backward operation mode is changed to the low-speed backward mode. Thereafter, because of the control signal produced from the switch SW2, the carriages move backward in the low-speed backward mode. When the carriages return to the initial position, the switch SW1 is turned on, and the movement mode is changed to the stop mode. Note that after turning on the switch SW2, the carriages moving by the inertia thereof cannot reach the initial position, and therefore they must be moved by the low-speed backward mode. As described above, the carriages can be satisfactorily stopped at the initial position.

The carriages may be moved in the backward other than the copying mode. First, the power is turned on, and second, the copying magnification is changed during the waiting mode. The lens unit 11 of this embodiment consists of the main lens $\mathbf{16}_1$ and the auxiliary lenses $\mathbf{16}_2$ to $\mathbf{16}_4$, as shown in FIG. 1. In the equal copying mode, the lens unit 11 is positioned at a position shown in FIG. 1. In the reduction copying mode, the main lens $\mathbf{16}_1$ moves along the direction indicated by the arrow b. In this case, both or either of the auxiliary lenses $\mathbf{16}_2$ and $\mathbf{16}_3$ in accordance with the selected copying magnification are set at a position overlapping the main lens $\mathbf{16}_1$, thereby correcting an optical path length. In the enlargement copying mode, the main lens $\mathbf{16}_1$ moves along the direction indicated by the arrow c, and the auxiliary lens $\mathbf{16}_4$ is set at a position overlapping the main lens $\mathbf{16}_1$. In this case, if the carriages move to the forward limit position along the direction indicated by the arrow b, the mirror 10 will abut against the auxiliary lens $\mathbf{16}_4$. In order to prevent this, in this embodiment, a limit switch SW3 for the enlargement mode is provided, which when activated stops the carriages from moving forward. When a plurality of enlargement magnifications are provided, a plurality of limit switches are also provided and forward limit positions are changed in accordance with the selected enlargement magnification.

For example, when the carriages are positioned at the forward limit position for the equal copying mode, the main lens $\mathbf{16}_1$ is moved along the direction indicated by the arrow c in order to change the copying magnification to the enlargement mode. In this case, the main lens $\mathbf{16}_1$ abuts against the mirror 10 on the way. In order to prevent this, in this embodiment, before the main lens $\mathbf{16}_1$ moves, the carriages always return to the scanning initial position. The backward operation of the carriages is as follows and will be described with reference to the timing charts shown in FIGS. 13A to 13E and 14A to 14E. The carriages move along the direction indicated by the arrow c in the low-speed backward mode (step 230). In this case, the microcomputer 39 sets a built-in timer at a predetermined interval T1 when the carriages start moving at the low-speed backward mode and starts counting. The carriages moved by this low speed movement stop at the initial position and the switch SW1 is turned on (step 233). In this case, the carriages were positioned between the switches SW1 and SW2. On the other hand, after the interval T1 elapses (i.e., the count of the timer ends), when both the switches SW1 and SW2 are off, the carriages were positioned between the switches SW2 and SW4. When the count of the timer ends in step 233, the high-speed backward mode is set in step 234. The following operation is the same as that of the backward operation in the copying operation. In this case, the time charts are as shown in FIGS. 13A to 13E. The interval T1 is expressed by $$T1 = L1 \times V1 + \alpha$$

where L1 is a distance between the switches SW1 and SW2, and $\alpha$ is a margin time. When the switch SW2 is turned on for the interval T1 (step 231), the carriages move to the initial position in the low-speed backward mode (step 236). In this case, the carriages were positioned between the switches SW3 and SW2, and the timing charts become as shown in FIGS. 14A to 14E.

Figure 15:
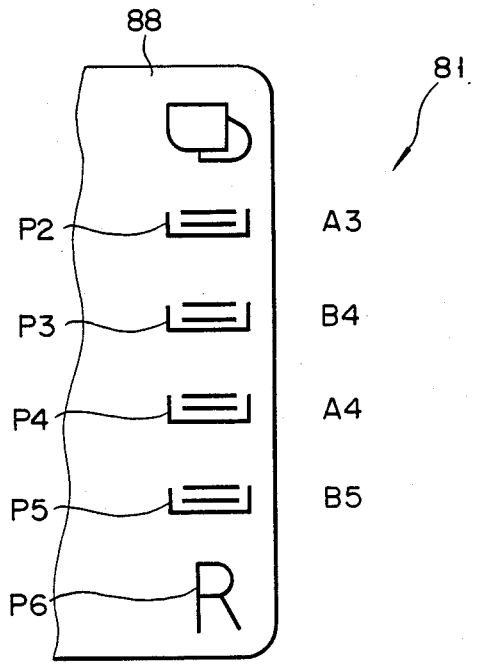
FIG. 15 shows a paper size display panel in the operation panel.

A displaying operation of the copying paper size will be described hereafter. The display operation of the copying paper size is performed by the display patterns P2 to P6 and the paper size displays 81, which are provided on the liquid crystal display panel 88, as shown in FIG. 15. The copying paper size is detected by the paper size detector 43, and the detection data is supplied to the microcomputer 39. The microcomputer 39 determines the paper size from the detection data and illuminates one of the corresponding four display patterns P2 to P5. For example, when the paper size is "A3", the display pattern P3 opposite to the "A3" display of the paper size displays 81 is illuminated, thus indicating that the selected paper size is "A3". The small paper sizes such as "A4", "B5" and the like have two setting directions, i.e., the longitudinal feeding mode for feeding the paper along the longitudinal direction thereof and the transverse feeding mode for feeding the paper along the transverse direction thereof. The longitudinal feeding mode is mainly used when the copying magnification is set in the reduction mode. On the other hand, the transverse feeding mode is mainly used when the copying magnification is set in modes other than the reduction mode. The display pattern P6 is provided for discriminating these longitudinal and transverse feeding modes. For example, when the paper sizes A4 and B5 having two setting directions are set, one of the display patterns P2 to P5 corresponding to the paper size and the display pattern P6 are illuminated, thereby indicating that the feeding mode is the longitudinal feeding mode. In this case, when the copying magnification is set in a mode other than the reduction mode, the copying operation can be performed faster in the transverse feeding mode than the longitudinal feeding mode. Therefore, in order to indicate the best mode to be set, both the display patterns flash. In this case, when the paper size having two setting directions is loaded in the transverse feeding mode, one of the display patterns P2 to P5 corresponding to the paper size is illuminated. When the copying magnification is set in the reduction mode, a part of the document cannot be copied onto a paper sheet. Therefore, the display patterns flash to inform this situation to the user. Furthermore, since large paper has only one setting direction, only the corresponding display panel is illuminated, and the flashing display is not performed.

With the above arrangement, when the copying key is depressed once, copies at all the copying magnifications and at the main copying densities can be obtained. Thus, since copy samples can be easily obtained, time and complex handling required for adjustment in the manufacturing process can be reduced. In addition, manufacturing cost can be reduced. Also, for the service man, time and complex handling required for checking each function of the copying machine can be reduced, thereby reducing service cost. Furthermore, since this specific operation mode can be normally inhibited by the mode changing switch, the user cannot erroneously operate the machine in the above specific mode.

In the above embodiment, copies of all the copying magnifications are formed in the continuous copying mode, but this is not always necessary. This operation can be performed only in the main copying magnifications.

In the above embodiment, the copying machine is described as an example. However, the present invention is not limited to this. For example, the present invention can be applied to other image forming apparatuses such as printers or facsimile systems.

As described above, according to the present invention, there can be provided an image forming apparatus in which time and complex handling required for adjustment can be considerably reduced even in the image forming apparatus in which the image forming instructions can be variably set.

What is claimed is:

1. An image forming apparatus comprising:

image forming means, responsive to an image signal and an instruction signal, for forming an image on an image forming medium in accordance with an image forming instruction;

designating means for generating a start signal which designates the start of a checking operation in accordance with an operation of an operating member; and instruction changing means for supplying one instruction signal in accordance with the start signal from said designating means, and when the image is formed in accordance with the image forming instruction, for sequentially supplying other instruction signals to said image forming means until all the instruction signals have been supplied to said image forming means.

2. An apparatus according to claim 1, in which the image forming instruction is a magnification of the image to be formed.

3. An apparatus according to claim 1, in which the image forming instruction is a density of the image to be formed.

4. An apparatus according to claim 1, in which said designating means serves as image forming designating means and selectively generates one of a check start designating signal and a normal image forming designating signal.

* * * * *